United States Patent [19]

Lamperti

[11] 4,173,135

[45] Nov. 6, 1979

[54] MACHINE FOR COILING METAL WIRE

[76] Inventor: Enrico Lamperti, Via Ercole Ferrario 4, Gallarate (Varise), Italy

[21] Appl. No.: 786,791

[22] Filed: Apr. 12, 1977

[30] Foreign Application Priority Data

Apr. 12, 1976 [IT] Italy ..... 83614 A/76

[51] Int. Cl.[2] ..... B21F 3/02; B21F 11/00

[52] U.S. Cl. ..... 72/21; 72/131; 72/138

[58] Field of Search ..... 72/19, 21, 22, 23, 26, 72/27, 30, 129, 131, 132, 135, 138, 142, 143

[56] References Cited

U.S. PATENT DOCUMENTS

| | | | |
|---|---|---|---|
| 2,393,804 | 1/1946 | Nigro | 72/131 |
| 2,455,863 | 12/1948 | Halvorsen | 72/131 |
| 2,902,079 | 9/1959 | Costello et al. | 72/131 |
| 3,740,984 | 6/1973 | Bergevin | 72/131 |
| 3,934,445 | 1/1976 | Lampietti | 72/129 |
| 4,026,135 | 5/1977 | Yagusic et al. | 72/142 X |
| 4,030,327 | 6/1977 | Collins et al. | 72/23 |

FOREIGN PATENT DOCUMENTS

| | | | |
|---|---|---|---|
| 1416670 | 11/1964 | France | 72/135 |
| 314245 | 9/1971 | U.S.S.R. | 72/138 |
| 421417 | 11/1974 | U.S.S.R. | 72/132 |

*Primary Examiner*—E. M. Combs
*Attorney, Agent, or Firm*—Young & Thompson

[57] ABSTRACT

An automatic machine for coiling metal wires to form springs including means for variably adjusting the diameter and the pitch of the spirally formed spring and for variably adjusting the length of the springs formed by said machine.

3 Claims, 11 Drawing Figures

FIG. 1
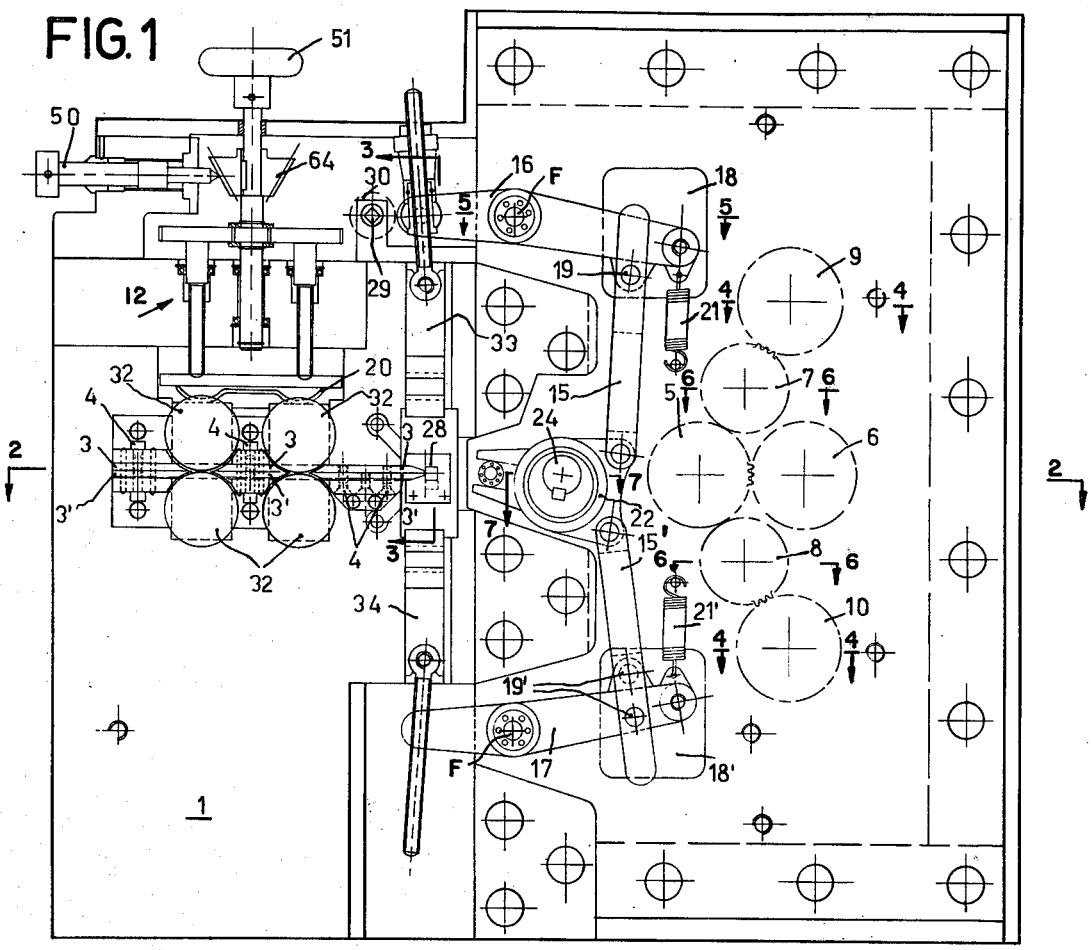
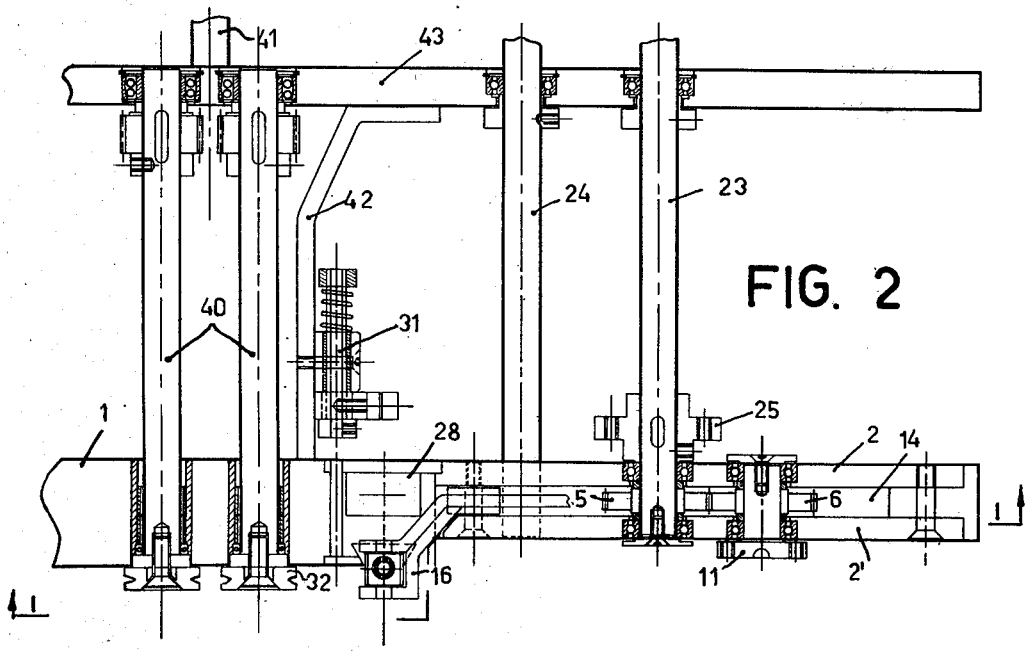
FIG. 2

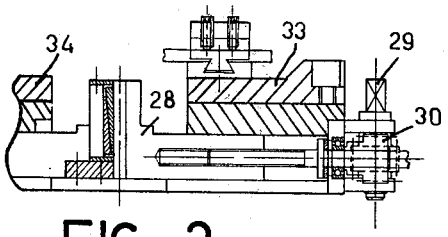
FIG. 3
FIG. 4
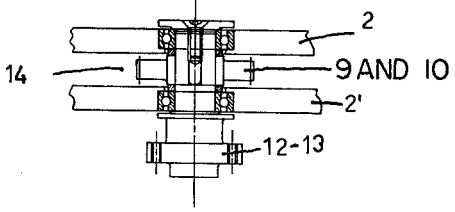
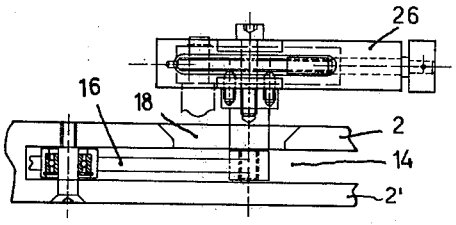
FIG. 5
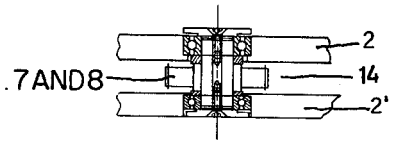
FIG. 6
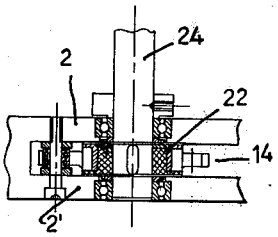
FIG. 7
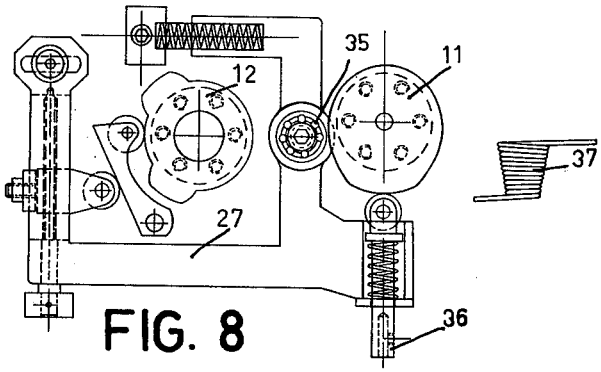
FIG. 8
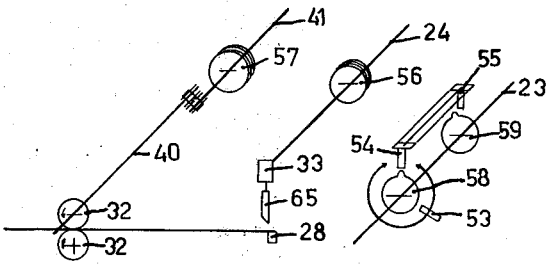
FIG. 9
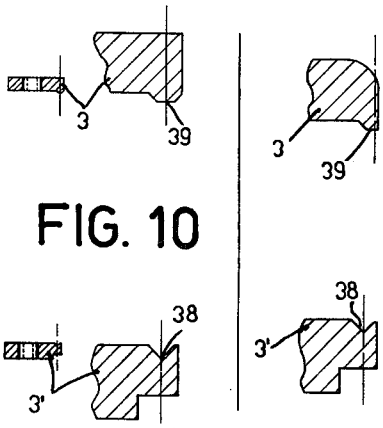
FIG. 10

MACHINE FOR COILING METAL WIRE

BACKGROUND OF THE INVENTION

I. Field of the Invention

This invention concerns an automatic machine for coiling metal wire.

II. Description of the Prior Art

An object of the present invention is to solve rationally, and with high productive performance, the problem of making spiral springs by coiling metal wire, and to provide for this an automatic machine embodying functional principles and technical structure by which it is possible to achieve practical results never previously obtained and incomparable in its operation through its harmonious perfection in the dynamics of its operation, being constructed of components which are simple and fulfill completely the aim which it is desired to satisfy, that is to say reduction of numbers of operative shafts, of leverages, of pawls, catches or the like, of mechanical clutches and like mechanisms and, moreover, wherein the need for a series of guides which are interchangeable according to the diameter of the wire being worked is obviated, with consequent reduction in the working and deformation of the wire itself and with substantial reduction in the time involved in preparation of the windings.

SUMMARY OF THE PRESENT INVENTION

With this object in view, the present invention provides an automatic machine for coiling metal wires to form springs, in which a wire is driven by two or more rollers into a guide towards two directing elements which determine the spiral diameter thereof, comprising at least one advancing device having intermittent cyclic operation for advancing the wire and determining the development of the spiral to be wound, a double cutting device for cutting the wire to permit detaching of the successive finished springs and having the form of a reciprocating shearer, a double device for retracting or spreading apart the helices of the compression spring to determine the spiral pitch, a servocontrol for each of the said three devices, and at least two speed-varying devices, characterized in that one or more or all of these devices are adjustable at a distance therefrom by means of adjusting members accessible at the outside of the machine.

DESCRIPTION OF THE DRAWINGS

The invention will be described further, by way of example, with reference to the accompanying drawings, in which:

FIG. 1 is a diagrammatic front view taken on the line 1—1 of FIG. 2 showing the mechanism present at the upper part of a practical embodiment of the machine of the invention, which machine is shown to a smaller scale in FIG. 11;

FIG. 2 is a diagrammatic part-sectional plan view showing certain of the details of the mechanism of FIG. 1 taken on the line 2—2 of FIG. 1;

FIG. 3 is detached fragmentary part-sectional plan view showing further details of the said mechanism taken on the line 3—3 of FIG. 1;

FIG. 4 is another detached fragmentary part-sectional plan view showing details of the mechanism taken on the line 4—4 of FIG. 1;

FIG. 5 is yet another detached fragmentary part-sectional plan view showing further details of the mechanism taken on the line 5—5 of FIG. 1;

FIG. 6 is another similar view showing more details of the mechanism taken on either one of the lines 6—6 of FIG. 1;

FIG. 7 is yet a further similar view showing more of said details taken on the line 7—7 of FIG 1;

FIG. 8 is a detached elevation showing further details of the mechanism;

FIG. 9 is a schematic perspective view illustrating the mode of operation of the machine;

FIG. 10 is an enlarged detached view illustrating the relationship between the wire guides of the mechanism of the preceding figures.

DESCRIPTION OF A PREFERRED EMBODIMENT

Figure 11:
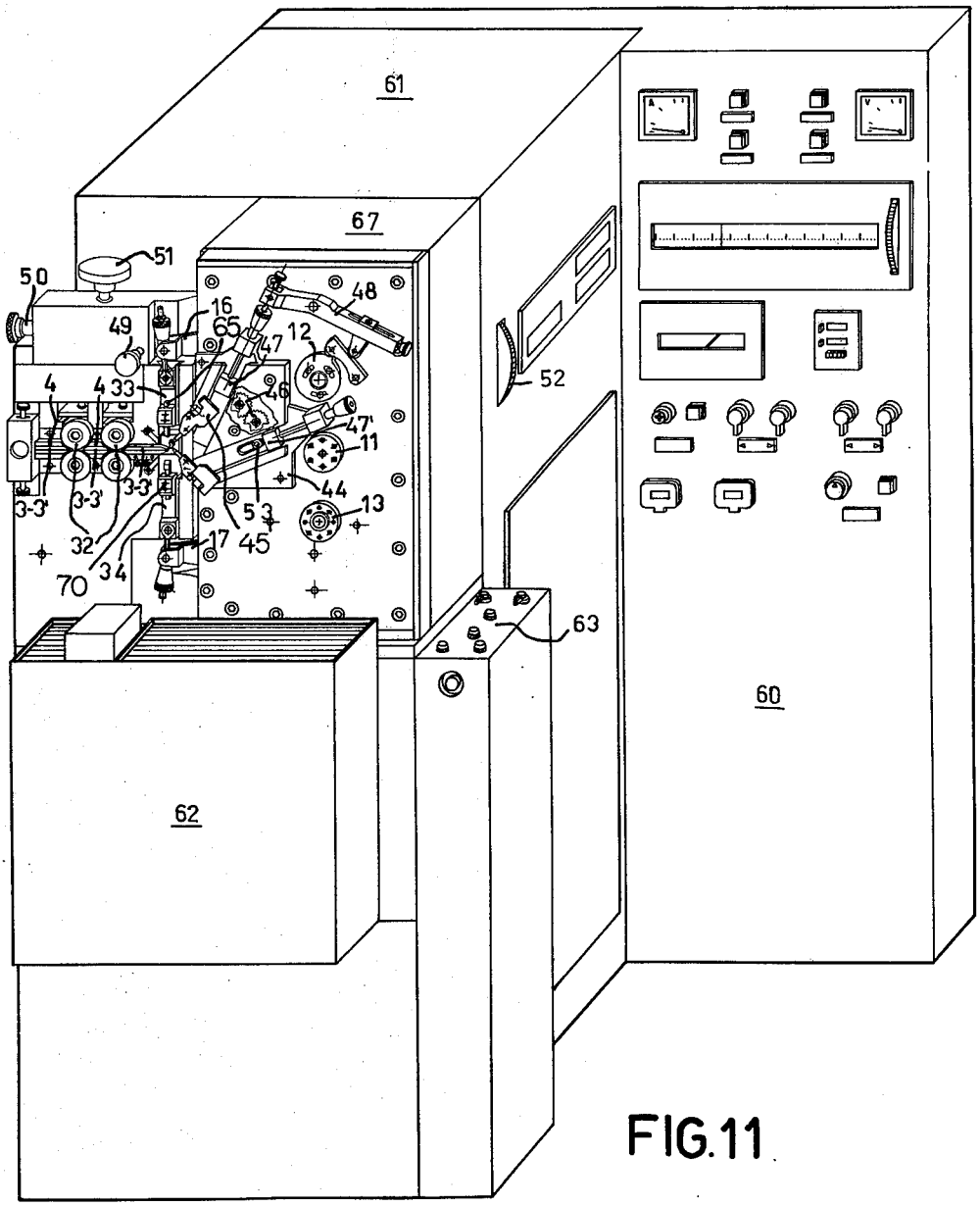
FIG. 11 is a perspective view illustrating the overall machine.

As shown in the drawings, for instance in FIG. 1., the preferred machine of the invention has a front face composed of three metal plates 1, 2 and 2' which being suitably anchored and made integral with another, create a hollow space 14 between the plates 2 and 2' accommodating the majority of the components necessary for the formation of springs, these being driven from a single drive shaft 23, through the agency of a train of gears 5, 6, 7, 8, 9, and 10, and three rotating hubs 11, 12, 13. The space contains an eccentric 22 controlled by a shaft 24 which can, by way of a link 15, be detachably connected at pivot 19 to conrol a lever 16, loaded by the spring 21, which actuates a slide 33. When the eccentric 22 is thus connected with the lever 16 by a pivot pin in the pivot 19, a lever 17 loaded by a spring 21' through window 18' is connected to a device 26 (FIG. 5) controlled by a cam-carrier 25, which actuates a slide 34.

Reversal of the link-up between the link 15 and the eccentric 22 provides for the lever 16 to be connected through the space of window 18 to movable device 26 instead, to actuate the slide 33, while the eccentric 22 actuates the slide 34 through the link 15' and lever 17.

Adjacent the plates 2, 2', the plate 1 has mounted thereon adjustable wire guides 3 and 3' disposed along the line of advance of a wire entrained by wire-drawing rollers. These adjustable wire-guides (shown in detail in FIG. 10) are positioned upstream, between and after the wire-drawing rollers, and are each divided into two half guides registering with one another, of which one through position is afforded by the half guide 3' which is fixed by means of suitable screws to the plate 1 and the other through position is afforded by the half guide 3 which is adjustable vertically by means of suitable adjusting screws 4.

FIG. 10 illustrates possible cross-sections for the adjustable guides 3 and 3', from which it will be seen that the half guides 3' are provided, in addition to fixing and registration holes, with triangular recesses 38 which are complementary to respective frusto-cones 39 formed in the moving half guides 3. When the cone frustum 39 of the half guide 3, upon adjustment with the screws 4, is engaged into the triangular recess 38 of the fixed half guide 3', there arises, between the plane of the tip of the cone frustum 39 and the exposed walls of the recess 38, a wire working space. This space is minimum with full registration of the frustum 39 into the recess 38; the more the half guides 3 are separated, by adjustment, from their fixed half guides 3', the greater is the wire working space so that the machine can be used for working metal wires of increasing diameter up to a maximum handleable by the winding machine.

Metal wire, passing between the adjustable guides, slides between the latter, being displaced by rollers 32 which, too, each have a triangular recess in which the metal wire engages. Gripping of the wire is achieved by means of a device 12 mounted on the plate 1 (FIG. 1) which makes it possible to set exactly the pressure by which the rollers 32 press on the wire. A device 30, illustrated non-restrictively in FIG. 3, actuates, through gearing having helical teeth, a carriage 28 which carries a countercutter blade, an actuating stub 29 of which protrudes at the operative face of the winding machine so as to be rotatable by means of a removable hand-wheel (not shown).

Rotation of the shaft 23 (FIG. 2) is transmitted by the gears 5, 6, 7, 8, 9, and 10 situated in the hollow space 14 to the hubs 11, 12, and 13 which carry respective cams and the shaft 23 is provided with the rear cam-carrier 25 which, by means of the device 26 (FIG. 5) control a vertical retractor 70 positioned on the slide 33 or the slide 34, FIG. 4 shows the manner of location, within the hollow space 14, of the gears 9 and 10 and that the output of the latter is to the hubs 12 and 13 which can, of course, be driven in the same way even if they be located in a different position.

FIG. 6 shows the arrangement of the intermediate gears 7 and 8.

FIG. 7 shows how the control shaft 24 has the eccentric 22 mounted thereon so as to be disposed in the hollow space 14.

FIG. 5 illustrates a portion of the machine corresponding to the lever 16 where it is accommodated in the hollow space 14 and is connected, through the window 18, to the removable device 26 which is supported on the cam-carrier 25.

FIG. 3 shows a section to illustrate the location of the carriage 28 with the counter-cutter blade in the plate 1 which is in a position behind the slides 33 and 34 having the control device comprising the gears 30.

FIG. 2 shows a general section corresponding to FIG. 1, with the plate 1 penetrated by roller-carrying shafts 40, the plates 2 and 2' which form the hollow space 14, and the gears 5 and 6 with their output to the central hub 11. In FIG. 2, there is shown, also, a support panel 43 for the shafts 40 which are coupled to electric motors (not shown) by way of electromagnetic clutches (also not shown). This figure also shows drive shaft 41, the cut-off control shaft 24, clutch shaft 23 and a partition 42 which separates the two operative parts and on which is mounted a horizontal retractor device 31.

FIG. 8 shows how by means of the combined action of two of the three rotating hubs disposed at the front of the machine, it is possible to produce special coil springs like the conical torsion spring 37 shown in the figure.

FIG. 9 shows diagrammatically the operation of the winding machine.

FIG. 11 shows a general overall view of the winding machine from which it will be observed that it comprises a cabinet 60 housing any necessary electrical and electronic components. Section 61 of the cabinet 60 houses the electric motors and the electromagnetic clutches, already mentioned, for providing the necessary drive. Housing 62 accommodates members for forming eyes or end loops on the wire springs being wound, as well as appropriate control equipment, associated, for example, with manually operable buttons of a push-button panel 63. The section 67 houses the retractor devices 26 and 31, and a cleaning device 66 for cleaning and lubricating the wire.

FIG. 11 shows a plate 44, which carries slides 47 and 47' in turn carrying winding points 45 and 45'. The plate 44 is fixed to the front face of the casing by screws and has behind it a cavity capable of accommodating toothed sectors 46 of which one is integral with the slide 47 and the other is independent and is fixed in the desired position to the slide 47' by means of a locking screw 53. The slides 47 and 47' and the toothed sectors 46 are actuated by a control lever 48 from the cam-carrying hub 12.

The plate 44 shown in FIG. 11 is shaped to produce clockwise-wound springs; to execute anticlockwise-wound springs one substitutes an alternative plate 44 in inverted position to cooperate with the cam-carrying hub 13 in the place of the hub 12. Because there are the plurality of cam-carrying hubs 11, 12, and 13, specially-shaped coils can be produced. By way of example, one can apply the device 27 shown in FIG. 8 so as to be pivoted on a bearing 35 controlled by the cam-carrying hub 12 which, with a retractor interposed which regulates the travel thereof, causes the device 27 to rotate, thereby allowing the wire-drawing rollers to progress forward a section of straight wire, after which it returns into the normal position.

The pushing of the straight wire is such as to project past the blade carried by the carriage 28 by means of a suitable winding point mounted on the retractable point-carrier 36, which is actuated by the cam-carrying hub 11 and which allows it to withdraw as a function of the profile of the cam which it has applied. When the conical winding cycle is finished, the cam carried by the hub 12 once again rotates the device 27, thereby thrusting forwards the wound spring, after which the cut occurs and the cycle repeats from the start.

The operation of the machine, and means for effecting optical checking thereof is illustrated diagrammatically in FIG. 9, and is as follows: One firstly rotates hand-wheel 51 which controls the three of the gears whose pivots are engaged so as to act on the spring 20, (FIG. 1) until the outer surface of notched cone 64 encounters a graduated measurer 50. One then proceeds, on the basis of the development of the wire of the spring to be constructed, to adjust the optical detectors which control electromagnetic clutch 57, combined with a brake, located on the shaft 41 and which controls movement of the roller-carrying shafts 40, actuating the graduated pulley 52 (FIG. 11) which acts on mobile optical head 53 which is swingable around the axis of the drive shaft 23. When the position of optical head 53 is determined the reader (or pick-up) 58 passing under the head 53 allows an electrical command to pass to electromagnetic clutch 57 which causes rotation of the wire-drawing rollers 32, 32 until the pick-up 58 encounters optical head 54 in a fixed position, which disconnects the clutch 57 stopping the wire-drawing rollers. Between the cycle end head 54 and the productive cycle start head 53 there acts the pick-up 59 which, by way of the optical head 55, provides for control of the electromagnetic clutch or electromagnet 56 which causes the cut-off shaft 24 to carry out a complete revolution. This, in its turn, acts on the eccentric 22 connected by the link 15 to the lever 16 which controls the slide 33 carrying cutting knife 65. Actuation of the levers 16 and 17 (which by way of the displaceable device 26, controlled by the cam-carrier 25, actuates the slide 33 or slide 34, when the latter have a coil-retracting or spreading function) can be effected with the use of thrust electromagnets (not shown) with an interposed drive shaft or the like which, alone as a function of the work to be carried out, acts on the levers 16 or 17.

Modification to convert the apparatus from producing right-hand springs to left-hand ones is effected by releasing the link 15 from the lever 16, rotating the shaft 24 by half a turn, connecting the shaft 24, by way of the holes 19', through the link 15' to the lever 17 thereby to transfer control to the slide 34 which effects cutting-off of the wound spring.

I claim:

1. An automatic machine for coiling metal wires to form springs, comprising power driven means (40, 32) to advance wire to be coiled, means (36) to coil the advanced wire, a pair of slides (33, 34) disposed on opposite sides of the path of advance of the wire, a retractor (70) detachably mounted on one of said slides (33, 34) for opening a coiled wire, a cutter (65) detachably mounted on the other of said slides (33, 34) for severing a length of coiled wire, said cutter (65) and retractor (70) being adapted to be interchangeably mounted on either of said slides (33, 34), a first power-driven shaft (24) having means (22) for imparting to either of said slides a wire cutting movement, a second power-driven shaft (23) having means (25) to impart to either of said slides a coil retracting movement, and means (15, 15', 16, 17) for selectively interchangeably interconnecting either of said shafts (23, 24) with either of said slides (33, 34) thereby selectively to adapt said machine to the formation of right-hand coils or left-hand coils.

2. A machine as claimed in claim 1, and optical detector means responsive to the rotated position of said second shaft (23) to control the operation of said wire advancing means (40, 32).

3. A machine as claimed in claim 1, and wire guides (3, 3') for guiding said wire in its advance toward said coiling means (36), said wire guides being movable toward and away from each other, and one of said wire guides having a V-groove (38) therein to accommodate wires of different diameters.

* * * * *